United States Patent [19]

Parker et al.

[11] 4,441,310

[45] Apr. 10, 1984

[54] FRICTION SPINNING APPARATUS

[75] Inventors: Alan Parker, Bolton; Douglas O. Clough, Rossendale, both of England

[73] Assignee: Hollingsworth (U.K.) Limited, United Kingdom

[21] Appl. No.: 496,745

[22] Filed: May 20, 1983

Related U.S. Application Data

[63] Continuation-in-part of Ser. No. 349,541, Feb. 17, 1982.

[30] Foreign Application Priority Data

Feb. 21, 1981 [GB] United Kingdom ..... 8105573

[51] Int. Cl.[3] ..... D01H 7/892; D01H 1/135

[52] U.S. Cl. ..... 57/401; 57/5

[58] Field of Search ..... 57/5, 400, 401, 408, 57/352

[56] References Cited

U.S. PATENT DOCUMENTS

| | | | |
|---|---|---|---|
| 4,060,966 | 12/1977 | Konig | 57/401 |
| 4,107,909 | 8/1978 | Fehrer et al. | 57/5 |
| 4,130,983 | 12/1978 | Dammann et al. | 57/5 |
| 4,202,163 | 5/1980 | Turk et al. | 57/401 |
| 4,222,222 | 9/1980 | Didek et al. | 57/5 X |
| 4,249,368 | 2/1981 | Fehrer | 57/5 |
| 4,281,507 | 8/1981 | Didek et al. | 57/411 X |
| 4,315,398 | 2/1982 | Parker et al. | 57/401 |
| 4,327,545 | 5/1982 | Fehrer | 57/401 X |
| 4,334,400 | 6/1982 | Fehrer | 57/401 X |
| 4,362,008 | 12/1982 | Parker et al. | 57/401 X |

*Primary Examiner*—Donald Watkins

*Attorney, Agent, or Firm*—Donald H. Feldman

[57] ABSTRACT

A friction spinning apparatus comprises two rollers in closely spaced parallel arrangement which define between them a yarn formation zone at an elongate gap along the rollers and a feed duct which extends into the gap so as to feed fibres directly into the gap in such a manner that they can fall directly onto the yarn. The feed duct is formed as two separate parts slightly toward the roller which turns into the gap so as to increase the proportion of fibres joining the yarn at the junction with that roller, one of which includes a planar jointing face of the feed duct and a co-planar first side wall of the fibre feed duct passage in the feed duct, and the other is a complex part defining the other walls of the fibre feed passage as well as a second planar jointing face.

5 Claims, 2 Drawing Figures

FRICTION SPINNING APPARATUS

REFERENCES TO CO-PENDING APPLICATIONS

This application is a continuation-in-part of our application Ser. No. 349,541 filed Feb. 17, 1982.

BACKGROUND OF THE INVENTION

This invention relates to apparatus for open-end spinning of yarn and particularly to apparatus of the type known as friction spinning.

PRIOR ART

Apparatus of this type has been proposed previously in many publications. One specific example is shown in U.S. Pat. No. 4,315,398 (Parker et al) and comprises two rotatable bodies each providing a surface and arranged such that the surfaces define between them an elongate gap which narrows towards a line of closest approach of the surfaces, means for rotating one of the bodies in a direction such that its surface moves into the gap and the other body such that its surface moves out of the gap to twist the fibres in the gap to form a yarn, means for withdrawing the yarn along the gap, and a fibre feed duct which extends right into the elongate gap to feed fibres substantially directly into the gap such that some fibres can fall directly on to the yarn.

Apparatus of this type has also been disclosed in a number of patent specifications by Dr. Ernst Fehrer, for example published British Application No. 2,002,152, and have achieved some commercial success. However improvement in yarn quality is an ongoing and fundamental requirement to ensure the widest commercial acceptability of the yarns from the apparatus. In these prior apparatus, the fibres are fed substantially symmetrically on the two bodies or rollers and this has always been an accepted principle in apparatus of this type to maintain the symmetry of the system.

Neither of these disclosures teaches any particular form of construction for the fibre feed duct. However, we now believe not only the length of the feed duct (in terms of its ability to guide the fibres directly onto the forming yarn) but also its construction are important.

SUMMARY OF THE INVENTION

Accordingly the invention is characterized in that the fibre feed duct is formed of two parts of which one has a planar portion defining one side wall of the fibre feed passage along the duct and the other defines an opposite side wall and end walls which in the assembled fibre feed duct extend between the side walls.

BRIEF DESCRIPTION OF THE DRAWINGS

One embodiment of the invention will now be described in more detail in the following description when taken together with the accompanying drawing in which.

DESCRIPTION OF THE PREFERRED EMBODIMENTS

Figure 1:
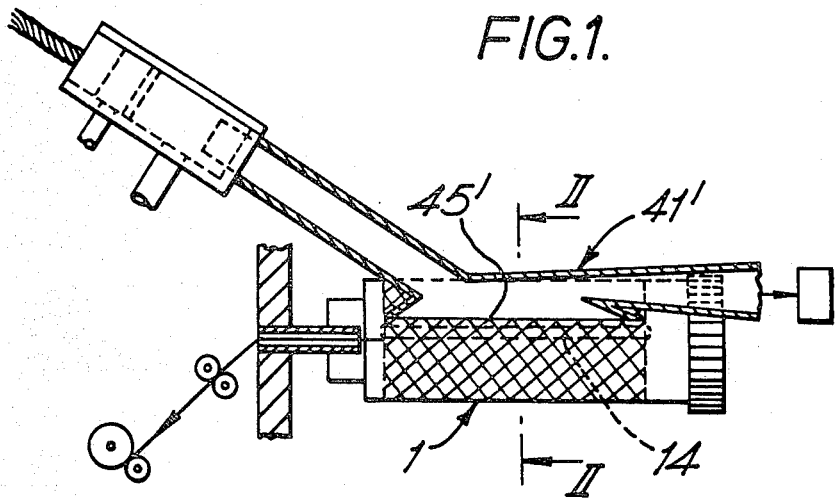
FIG. 1 is taken from Published British Application No. 2,042,559A and shows schematically a friction spinning apparatus of this type.
Figure 2:
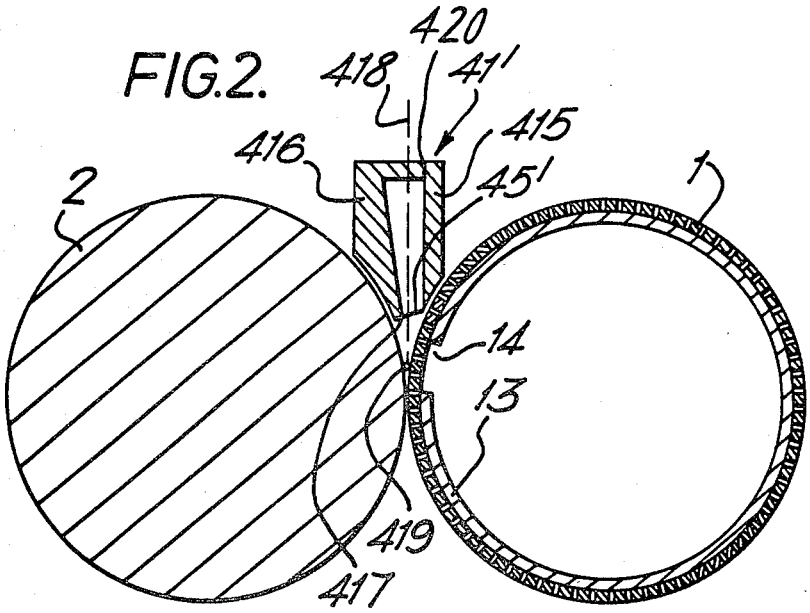
FIG. 2 is an enlarged section on the lines II—II of FIG. 1 showing the modified apparatus according to this invention.

Referring firstly to FIG. 1, the structure and operation of this apparatus is fully disclosed and described in U.S. Pat. No. 4,315,398 and those unfamiliar with this application should refer to that specification for a detailed description of the apparatus. The apparatus described therein has been modified according to the present invention by the provision of a feed duct 41' as shown in FIG. 2. The reference numerals used in the following description where possible are the same as used in the above specification.

The duct 41' extends to an elongate mouth 45' positioned closely adjacent and parallel to the line of closest approach of the rollers 1 and 2, that is it extends into the narrowing gap between the rollers to a position closer to the line of closest approach than the radius of curvature of the rollers. In practice the mouth 45' is spaced less than 10 mms from the yarn formation position which in turn is spaced from the line of closest approach by 2 or 3 mms.

The schematically illustrated fibre feed duct 41' is formed in two parts, that is one part 415 defining a plane flat side wall which extends vertically and another part 416 which is complex in shape as including an opposite side wall exhibiting near the mouth 45' a taper toward the mouth 45' and all structural parts of the duct 41' (e.g. the front and rear end wall parts shown in section in FIG. 1) which are necessary to co-operate with the flat wall to form the complete feed duct 41'. Since the right hand side wall of the fibre feed duct (defined on the right hand part 415) is coplanar with the plane of partition 420 between planar jointing faces of the respective parts 415 and 416 the corners at the right hand side of the fibre feed duct adjoining the right hand side wall are all defined solely by the edges of the front and rear side walls (FIG. 1) of the fibre feed duct: they are therefore defined solely by the left hand feed duct part 416. As a result there is no likelihood of undesirable fibre entrapment areas at those corners as a result of inaccurate alignment of the left hand and right hand feed duct parts 416 and 415 as the duct is assembled. Provided the corresponding edges of the front and rear walls (and the top wall) of the fibre feed duct portion 416 are adequately de-burred after machining, the incidence of fibre entrapment areas will have been minimized.

Preferably the left hand side wall will itself be of non-planar form so that where the fibre feed duct has a compound taper (as viewed in FIG. 2) all the taper is defined by the complex left hand part 416.

As described in the above U.S. Pat. No. 4,315,398, the roller 1 is perforated and includes a suction duct 13 inside including a narrow slot 14 along the length of the rollers to define a narrow elongate area on the roller 1 through which air is drawn. The roller 2 is imperforate. The roller 1 rotates in a direction such that observed from the side of the feed duct 41' it moves into the gap and the roller 2 moves in the same rotational sense such that it moves out of the gap.

The duct 41' thus, as disclosed in said U.S. Pat. No. 4,315,398 and in a pending U.S. patent application No. 308,955 (Parker et al) filed Oct. 6, 1981, is arranged to feed the fibres substantially directly into the gap such that some can fall directly onto the yarn. It will be appreciated that it is very difficult if not impossible to determine exactly where the fibres are deposited, but it is clear that this arrangement is different from one wherein the fibres are clearly aimed and directed at the wall of one of the rollers, and are prevented from directly falling onto the yarn.

The duct of the present invention is however modified such that the mouth is biassed to the side adjacent the perforated roller 1. More specifically the mouth 45' opens such that one side lies substantially immediately adjacent the roller 1 while a spacer surface 417 lies between the other side and the roller 2. Of the total mouth width, of the order of 75% lies on the side of the central plane (shown at 418) adjacent the roller 1. The inner surface of the side wall of duct part 416 includes all the taper of the feed duct and is directed such that an extension would intersect the yarn (shown at 419) or the junction of the yarn 419 and the roller 1. The duct 41' may be more biassed than as shown in FIG. 2, but not so far that fibres are prevented from falling directly onto the yarn. The side of the mouth adjacent the roller 2 lies on the same side of the central plane 418 as the roller 2.

In this way the duct 41' tends to direct more of the fibres, than would be the case with the prior arrangements, toward the roller 1. As explained above it is not possible to determine exactly how many fibres are deposited on a particular area but it is clear that the duct has a tendency to direct more fibers toward the roller 1 than toward the roller 2. In addition it should be noted that because the whole of the taper lies in the left hand side wall, more of the fibres will be travelling on that side of the duct.

An explanation for the improved performance cannot be given with certainty because of the difficulty of determining the exact path of fibres but it is believed that the following occurs. A larger proportion of fibres is thus aimed to join the yarn at or adjacent its junction with the roller 1 and a smaller proportion of fibres joins the yarn at the junction between the yarn 419 and the roller 2. Some fibres may first encounter the surface of the roller 1, but they do so at a very shallow angle and for a very short distance and hence their orientation is very little affected by their contact with the roller before they encounter and join the yarn. Fibres which join at the roller 1 are it is believed rolled between the yarn and the roller 1 and hence join the yarn smoothly. Fibres which join at the roller 2 firstly are flung around the upper surface of the yarn by the rotation of the yarn and hence do not joint into the yarn as smoothly as those at the roller 1.

We claim:

1. In an apparatus for open-end spinning of yarn, of the type comprising two rotatable bodies each having a surface and arranged such that the surfaces define an elongate gap which narrows toward a line of closest approach of the surfaces, means for rotating one of the bodies in a direction so that the surface moves into the gap and means for moving the other body in a direction so that the surface moves out of the gap to twist fibres in the gap to form a yarn, means for withdrawing the yarn along the gap, and a fibre feed duct having an elongate mouth within the gap and defining a fibre feed passage having opposite side walls to feed fibres substantially directly into the gap such that some fibres can fall directly on to the yarn, the improvement wherein the fibre feed duct is formed of first and second parts, said first part including a first planar portion defining a first planar jointing face between said first and second parts and also a first of said opposite side walls of said fibre feed passage, and said second part includes a second planar jointing face to contact sealingly said first planar jointing face when the said first and second parts are assembled together to form said fibre feed duct, and said second part further defining a second of said opposite side walls and also end walls of said fibre feed passage which extend between said first and second opposite side walls.

2. The improvement according to claim 1, wherein the feed duct has a compound taper toward the elongate mouth when viewed in a transverse plane, said first side wall of the feed duct is flat and all the taper is formed by the opposite second side wall.

3. The improvement according to claim 2, wherein the said first side wall ends adjacent the surface which moves into the gap.

4. The improvement according to claim 3, wherein said first side wall is substantially at right angles to the plane containing the axes of rotation of the bodies.

5. The improvement according to claim 1, wherein the edge of the said first side wall at one side of the elongate mouth lies substantially immediately adjacent the surface which moves into the gap.

* * * * *